US011739454B2

(12) United States Patent
Miller, III

(10) Patent No.: US 11,739,454 B2
(45) Date of Patent: Aug. 29, 2023

(54) METHOD FOR WET PROCESSING OF HEMP FIBERS

(71) Applicant: BASTCORE, INC., Homewood, AL (US)

(72) Inventor: Robert A. Miller, III, New Ringgold, PA (US)

(73) Assignee: Bastcore, Inc., Homewood, AL (US)

( * ) Notice: Subject to any disclaimer, the term of this patent is extended or adjusted under 35 U.S.C. 154(b) by 0 days.

(21) Appl. No.: 17/422,724

(22) PCT Filed: Dec. 31, 2020

(86) PCT No.: PCT/US2020/067752

§ 371 (c)(1),
(2) Date: Jul. 13, 2021

(87) PCT Pub. No.: WO2021/138615

PCT Pub. Date: Jul. 8, 2021

(65) Prior Publication Data

US 2022/0396904 A1 Dec. 15, 2022

Related U.S. Application Data

(60) Provisional application No. 62/955,981, filed on Dec. 31, 2019.

(51) Int. Cl.
*D06B 3/02* (2006.01)
*D06B 5/14* (2006.01)

(52) U.S. Cl.
CPC ..... *D06B 3/02* (2013.01); *D06B 5/14* (2013.01); *D10B 2201/01* (2013.01)

(58) Field of Classification Search
CPC ..... D06B 3/02; D06B 5/14; D10B 2201/01
(Continued)

(56) References Cited

U.S. PATENT DOCUMENTS 1,842,024 A * 1/1932 Hollander ..... D01C 1/04 435/933
4,106,979 A * 8/1978 Ruffini ..... D21C 3/222 8/111

(Continued)

FOREIGN PATENT DOCUMENTS

CN 104278335 A 1/2015
WO 2015/179380 A1 11/2015

OTHER PUBLICATIONS

International Search Report, dated Apr. 22, 2021 for Appl. No. PCT/US20/67752, filed Dec. 31, 2020.

(Continued)

*Primary Examiner* — David G Cormier
*Assistant Examiner* — Thomas Bucci
(74) *Attorney, Agent, or Firm* — ADAMSIP, LLC; James Adams; Stephen Thompson

(57) ABSTRACT

A method for wet processing of hemp fibers for commercial use is provided. The method includes steps of loading raw hemp fibers with water into a vessel and heating the contents of the vessel. The method also includes the addition of a sequence of certain chemical compounds, which include a scouring agent, a wetting agent, a caustic compound, an acidic compound, a lubricant, and a softening agent. The water may be heated to boiling during the process to aid in opening up the fibers during processing. Peroxide is not utilized in the process. The process produces commercially viable quantities of hemp fibers that are soft, clean, and easily spinnable while maintaining fiber burst strength.

16 Claims, 2 Drawing Sheets

(58) Field of Classification Search
USPC ..... 8/156
See application file for complete search history.

(56) References Cited

U.S. PATENT DOCUMENTS

| | | | | |
|---|---|---|---|---|
| 4,568,739 | A * | 2/1986 | Jaskowski | D01C 1/02 536/2 |
| 4,617,383 | A * | 10/1986 | Jaskowski | D01C 1/02 536/2 |
| 8,591,701 | B2 * | 11/2013 | Sung | D01C 1/02 162/76 |
| 10,415,155 | B2 * | 9/2019 | Yoshida | D06M 16/00 |
| 2005/0005373 | A1 * | 1/2005 | Buchel | D06L 1/22 8/636 |
| 2015/0166745 | A1 * | 6/2015 | Henry | D01B 1/00 19/205 |
| 2015/0337496 | A1 * | 11/2015 | Lee | D04H 1/4266 15/104.93 |
| 2016/0186368 | A1 * | 6/2016 | Lim | D06F 29/02 68/23 R |
| 2019/0264385 | A1 * | 8/2019 | Pauwels | D21B 1/04 |
| 2019/0390368 | A1 * | 12/2019 | Hefner | D01B 1/32 |

OTHER PUBLICATIONS

Written Opinion of the International Searching Authority, dated Apr. 22, 2021 for Appl. No. PCT/US20/67752, filed Dec. 31, 2020.

* cited by examiner

METHOD FOR WET PROCESSING OF HEMP FIBERS

CROSS REFERENCES

This application is a U.S. National Stage application of PCT Application No. PCT/US20/67752, filed on Dec. 31, 2020, which claims priority to U.S. Provisional Application No. 62/955,981, filed on Dec. 31, 2019, which application is incorporated herein by reference in its entirety.

FIELD OF THE INVENTION

The present invention relates generally to a method for wet processing of hemp fibers for commercial use.

BACKGROUND

Hemp fibers, which are commonly called bast fibers, have been used extensively throughout history to make a variety of items, such as fabrics, textiles, rope, clothing, shoes, bioplastics, and insulation, as well as other products ranging from paper to bedding to building materials used for construction and manufacturing applications to canvas used for sails. To process raw hemp fibers for commercial use, the hurd and bast fibers must be separated in a process known as decortication, which may be carried out by a commonly known machine called a decorticator. Currently, hemp is generally harvested and then baled before being processed by a decorticator, which pulls the hemp fibers out of the plant stalks and separates the fibers from the outer bark of the stalks. The fibers may then be sold directly into the commercial market to spinners to be spun into yarn. In this case, the fibers may undergo a worsted spinning process, which may be able to handle longer fibers and dirt or other contaminants present with the raw fibers. This process is a conventional process used for hand-knitting yarn for making textiles or other types of fabrics. However, this process is not generally suitable for industrial-scale production of hemp fibers for commercial use.

For commercial production of hemp fibers, some producers have utilized a wet processing method to clean and break apart the fibers. Such known wet processing methods typically utilize peroxide to aid in breaking the fibers apart. However, the use of peroxide causes degradation of the fibers, which causes the fibers to become brittle and diminishes the burst strength of the fibers. In addition, when wet processing hemp fibers, the fibers have a tendency to clump, cake, mat, and form fiber knots. Further, current wet processing methods do not sufficiently remove dirt or other hemp plant trash carried by the fibers when processed in a wet preparation vessel. Currently utilized market chemistry and process procedures do not sufficiently overcome these impediments, even with further mechanical processing, thus making the hemp fibers unsuitable for conventional textile spinning into yarn for knitting or weaving, or into a fiber to be used in a non-woven fabrication.

Accordingly, a need exists in the art for an improved method for wet processing of hemp fibers that overcomes the deficiencies outlined above.

SUMMARY

In one aspect, a method of wet processing hemp fibers for commercial use is provided. The method comprises loading raw hemp fibers into a vessel with water to form a first water bath, heating the first water bath containing the raw hemp fibers, first adding a scouring agent to the vessel, then adding a wetting agent to the vessel, then adding a caustic compound to the vessel, then adding an acidic compound to the vessel, then draining the first water bath from the vessel to leave wet hemp fibers remaining in the vessel, then refilling the vessel with water to form a second water bath containing the hemp fibers still remaining in the vessel, then adding a lubricant to the vessel, and then adding a softening agent to the vessel. The second water bath may then be drained from the vessel to leave wet hemp fibers remaining in the vessel. The wet processed hemp fibers may then be unloaded from the vessel and then dried to produce hemp fibers that are suitable for commercial production of fabrics or other products that may be made from hemp fiber.

The scouring agent is preferably a high-detergent, low-foaming scouring agent or surfactant selected to remove oils, waxes, and dirt from textile fibers. The wetting agent is preferably a dispersant, solubilizer, or after-scour solution. The caustic compound preferably comprises caustic soda beads dissolved in water, and the acidic compound preferably comprises acetic acid or a similar acid. The lubricant preferably comprises a lubricating compound suitable for aiding fabric processing and improving fabric quality. The softening agent is preferably a softening agent suitable for softening fabric and aiding fabric processing.

The present method preferably further includes additional steps of heating the water and hemp fibers contained within the vessel, including various chemical components that are added to the water to form an aqueous solution or mixture in various steps of the present method. The first water bath is preferably heated to a boiling temperature after the addition of the caustic compound to the vessel. In addition, the second water bath is preferably heated before the addition of lubricant to the vessel. The present method may further include steps of flowing fresh water into the vessel so that the fresh water flows into the aqueous solution and through the vessel for varying amounts of time after the addition of certain chemical additives. As fresh water is added to the vessel, liquid of the aqueous solution contained within the vessel may be simultaneously drained from the vessel. The amount of each chemical compound added may be determined according to the weight of hemp fiber being processed. The present method does not include the addition of peroxide in any step. After each step, a water sample and/or fiber sample may be taken from the vessel to determine the proper amount of time before proceeding to the next step. After the wet processing steps have been completed, the second water bath may be dropped from the vessel, and the wet processed hemp fibers may be unloaded from the vessel and dried. The present wet processing method is capable of producing commercially viable quantities of hemp fibers that are soft, clean, and easily spinnable. In addition, the present wet processing method allows the hemp fibers to realign during the drying process so that the fibers are parallel when further processed by a fiber carding machine.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DESCRIPTION OF THE DRAWINGS

These and other features, aspects, and advantages of the present invention will become better understood with regard to the following description, appended claims, and accompanying drawings where:

DETAILED DESCRIPTION

Figure 1:
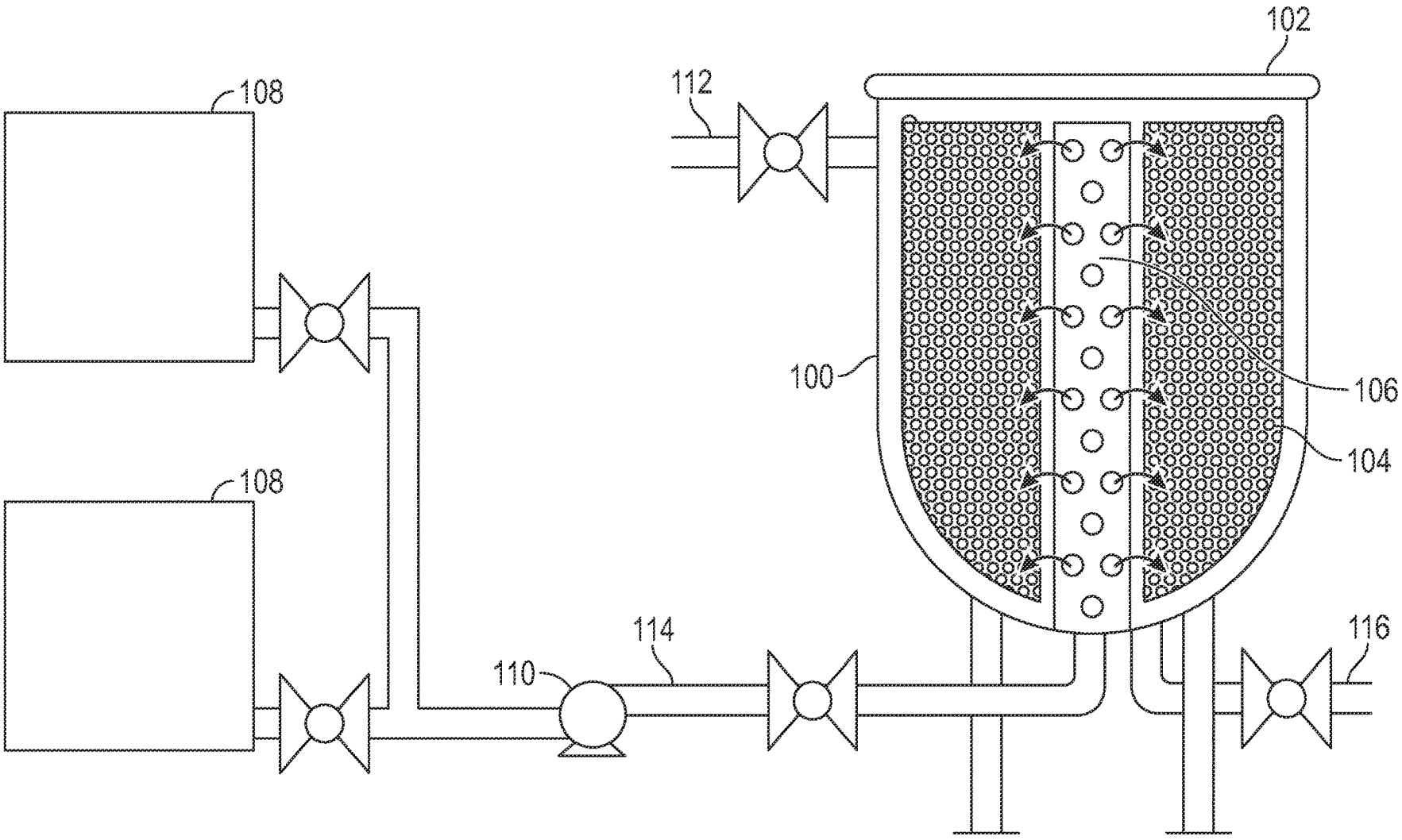
FIG. 1 shows a system for implementing a method for wet processing of hemp fibers for commercial use in accordance with the present disclosure.

The present invention provides a method of wet processing hemp fibers in accordance with the independent claims. Preferred embodiments of the invention are reflected in the dependent claims. The claimed invention can be better understood in view of the embodiments described and illustrated in the present disclosure, viz. in the present specification and drawings. In general, the present disclosure reflects preferred embodiments of the invention. The attentive reader will note, however, that some aspects of the disclosed embodiments extend beyond the scope of the claims. To the respect that the disclosed embodiments indeed extend beyond the scope of the claims, the disclosed embodiments are to be considered supplementary background information and do not constitute definitions of the invention per se.

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

In one aspect, a method of wet processing of hemp fibers for commercial use is provided. The method comprises the steps of: loading raw hemp fibers into a vessel with water, heating the water along with the raw hemp fiber contained inside the vessel, then adding a scouring agent to the vessel, then adding a wetting agent to the vessel, then adding a caustic compound to the vessel, then adding an acidic compound to the vessel, then draining the water from the vessel and refilling the vessel with fresh water while the hemp fibers remain in the vessel, then adding a lubricant to the vessel, and then adding a softening agent to the vessel. After these wet processing steps, the water may be drained again from the vessel, and the wet hemp fibers may be unloaded from the vessel and dried to produce fibers suitable for commercial production of fabrics or other products made from hemp fiber. The wet processing steps are preferably carried out in the sequence listed above with other optional steps that may be performed between the above-listed steps. The method does not include a step of adding peroxide to treat the hemp fibers.

Figure 2:
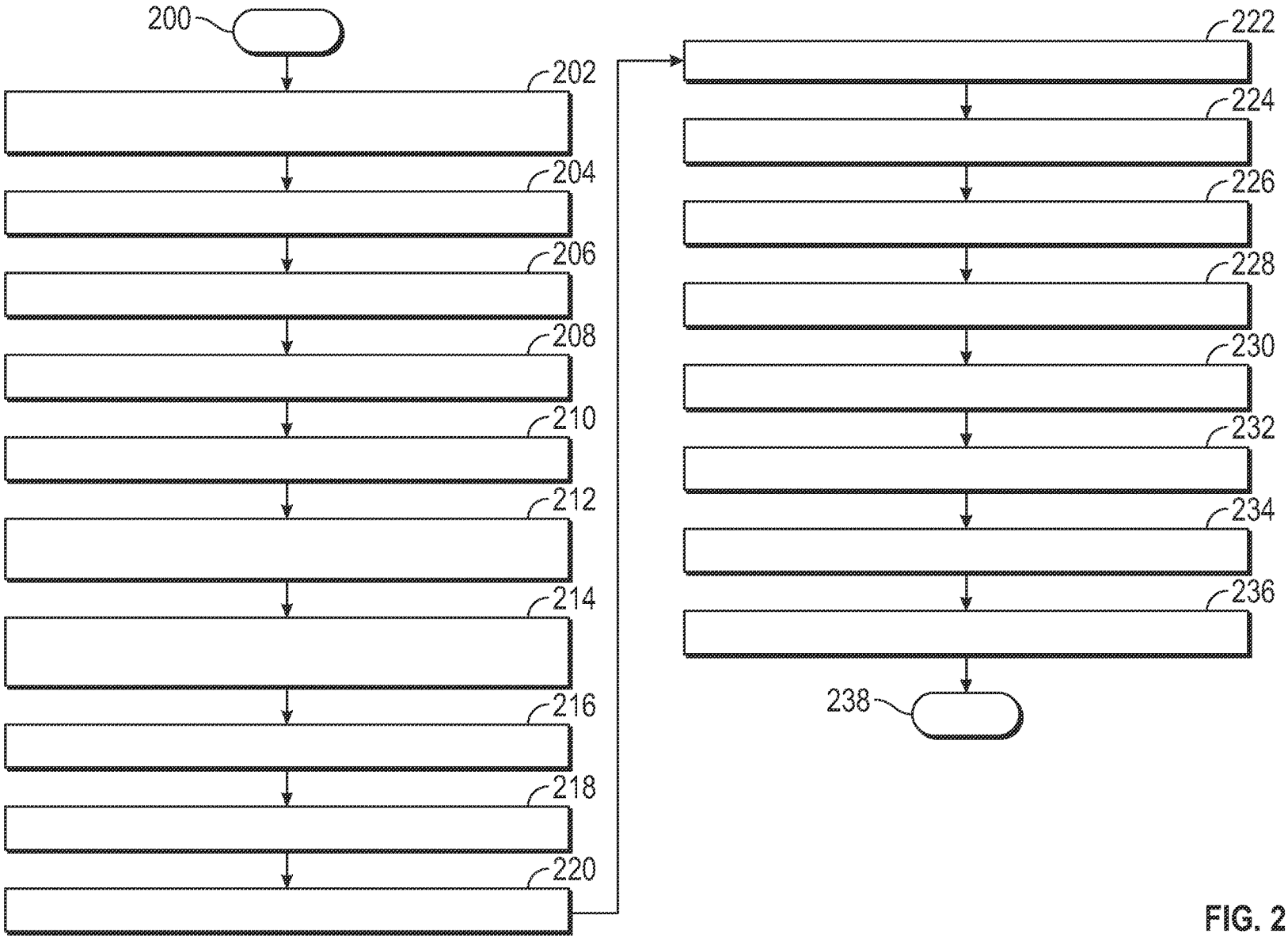
FIG. 2 shows a process flow diagram of a method for wet processing of hemp fibers for commercial use in accordance with the present disclosure.

FIG. 1 illustrates a system that may be utilized to carry out the present method shown in FIG. 2. The system comprises a vessel 100 that may be used to hold the hemp fibers, water, and all other components that are added into the vessel 100 in various steps of the present method. The vessel preferably comprises a pressure kettle 100 and a removable basket 104 that is sized and shaped to fit within the kettle 100, as shown in FIG. 1. To carry out the present method, raw hemp fibers may be loaded into the vessel with water to form a water bath by loading the raw hemp fibers into the basket 104 and placing the basket 104 within the pressure kettle 100 either before or after loading the hemp fibers into the basket 104. The pressure kettle 100 may then be filled with an amount of water sufficient to substantially cover the hemp fibers contained within the basket 104. The kettle 100 preferably has a removable lid 102 that can be tightened onto the kettle 100 so that the kettle 100 may be pressurized. The basket 104 may be lifted out of the kettle 100 or lowered into the kettle 100 by a crane for loading hemp fibers into the basket 104 and unloading hemp fibers from the basket 104. Once the basket 104 has been placed inside the kettle 100, the lid 102 may be closed and sealed. The kettle 100 preferably has a fresh water inlet line 112 positioned near a top end of the kettle 100 for adding fresh water into the kettle 100. The basket 104 preferably has a plurality of holes within the basket 104, as shown in FIG. 1, so that water may flow into the interior of the basket 104 where the hemp fibers are contained and to allow the basket 104 to drain when unloading the basket 104 with wet hemp fibers contained in the basket.

As shown in FIG. 1, the kettle 100 preferably further comprises a perforated pipe 106 disposed within the interior of the kettle 100 and configured to inject liquid compounds into the water bath contained within the kettle 100. The perforated pipe 106 is preferably fluidly connected to an external fill line 114, which is preferably connected to the bottom of the kettle 100. The pipe 106 may extend upwardly in a vertical orientation within the kettle 100 and may have a plurality of openings in the walls of the pipe 106 to allow liquids pumped into the pipe 106 to be injected into the water bath in the interior of the kettle 100 along the length of the pipe 106, as indicated by the arrows shown in FIG. 1. The system may include a pump 110 configured to pump liquids into the pipe 106 to carry out the present method. The basket 104 may preferably be shaped to fit around the vertical pipe 106 so that the pipe 106 does not interfere with installation into and removal of the basket 104 from the kettle 100. In alternative embodiments, other vessel arrangements and configurations may be utilized to carry out the present method. For instance, the vessel 100 may be configured to inject liquids into the water bath through overhead lines or lines connected to the side of the vessel rather than through a vertical pipe within the vessel, in which case the basket 104 may be shaped to conform to the contours of the vessel without needing to fit around an interior pipe. In addition, the vessel 100 may optionally include one or more internal nozzles configured to inject liquids into the pressurized kettle and to effectively force injected liquids to flow through the hemp fibers contained within the basket 104 so that the injected chemicals come into contact with the hemp fibers.

The system may preferably include one or more mix tanks 108 for mixing liquid chemical solutions or mixtures for injection into the kettle 100. FIG. 1 illustrates a system with two mix tanks 108, though the system may optionally include additional mix tanks 108 for preparing each of the liquid compositions to be added into the kettle 100 in various method steps of the present method. Liquid compounds contained within the mix tanks 108 may preferably be pumped by pump 110 into the perforated pipe 106 and injected into the water bath inside the kettle 100 through the openings in the pipe 106. Each mix tank 108 may optionally include a preheater or precooler, or heating or cooling elements, for heating or cooling the liquids to be injected into the kettle 100. The system preferably further includes a drain line 116 positioned on the bottom of the kettle for draining liquid from the kettle 100.

FIG. 2 illustrates a process flow diagram of a method that may be utilized for wet processing hemp fibers for commercial use in accordance with the present method. However, it should be understood by one skilled in the art that the method steps disclosed herein may be modified and still fall within the scope of the presently disclosed method. For instance, the amount of time for each step and/or batch run times between steps may be adjusted to achieve a desired result based on testing of water samples and/or fiber samples taken during the process of carrying out the present method. In some cases, batch run times may optionally be eliminated so that steps of adding various chemicals may be carried out without running the batch of hemp fibers between chemical addition steps. In addition, temperature set points described herein may also be adjusted to achieve desired results. Further, the order of some steps may be varied and still fall within the scope of the presently disclosed method.

As shown in FIG. 2, step 200 begins the present method. In step 202, raw decorticated hemp fibers are loaded into a vessel 100 with water to form a first water bath. At this stage, the hemp fibers are generally caked or baled together. The vessel is preferably a pressure kettle 100, and the hemp fibers are preferably processed in batches within the kettle 100. The lid 102 of the kettle may be hydraulically closed and sealed so that the kettle 100 may be pressurized. The kettle 100 may comprise a basket 104 with an open top and a perforated bottom and/or perforated sides so that liquid may flow into and out of the basket. The basket 104 is sized to fit inside the pressure kettle 100, as shown in FIG. 1. Once the hemp fiber is loaded into the kettle 100, the first water bath, including the fibers contained within the bath, may then be heated, preferably to a temperature of at least 150 degrees Fahrenheit, in step 204. The first water bath is preferably initially heated to a temperature of approximately 160 degrees Fahrenheit.

In step 206, a scouring agent is first added to the vessel 100. The scouring agent is added to the water bath containing the hemp fibers inside the kettle, preferably by pumping a liquid composition comprising the scouring agent from a mix tank 108 through the fill line 114 on the bottom of the kettle 100 and up through the perforated pipe 106 so that the scouring agent is forcefully injected into the first water bath through the openings along the length of the pipe 106. This causes the scouring agent to flow through the hemp fibers contained within the basket 104 inside the kettle 100 so that the injected scouring agent effectively comes into contact with the hemp fibers. A similar chemical injection procedure may be followed for each liquid chemical mixture injected into the interior of the kettle 100 through the perforated pipe 106 so that each injected chemical comes into contact effectively with the hemp fibers. The pump 110 and valves at the mix tanks 108 and on the fill line 114 may be utilized to control the flow of injected chemicals into the kettle 100 at various steps of the wet processing method. Alternatively, the kettle 100 may have a dedicated injection line for injecting each chemical to be injected into the kettle.

The scouring agent utilized in step 206 is preferably a scouring agent sold under the trademark Pomoscour L70™ by Piedmont Chemical Industries. Alternatively, the scouring agent utilized may be a similar scouring agent suitable for removing oils, waxes, and dirt from textile fibers, such as a scouring agent sold under the trademark Pomoscour HOS J™ or under the trademark Pomoscour NCFN™, both also sold by Piedmont Chemical Industries. After adding the scouring agent, the batch of fibers in the first water bath may preferably then be run for a period of approximately 5 minutes in step 208.

As used herein, a batch of fibers, which refers to a water bath containing fibers therein, is "run" by flowing fresh water into the water bath inside the pressure vessel 100 while simultaneously draining liquid of the water bath (which may include ingredients of one or more chemicals added to the bath) from the pressure kettle, preferably at approximately the same flow rate that fresh water is added. The pressure within the kettle is preferably maintained as close to a constant pressure as possible. The fresh water is preferably injected at the top of the pressure vessel while the water bath is drained from a separate line on the bottom of the vessel. As shown in FIG. 1, fresh water may be added through the fresh water fill line 112, while water is drained from the kettle 100 through the drain line 116 on the bottom of the kettle. Thus, "running" a batch causes the water bath to become diluted with fresh water over the time that the batch is run. One purpose of the steps of adding the scouring agent and running the batch, as well as various other steps of the present method, is to clean the hemp fiber of woody content, lignins, and dirt or other contaminants. A liquid sample of the water bath may be taken to determine if the bath should be run for a longer period of time in step 208 or in other subsequent steps that include running the batch. The liquid sample from the water bath, also referred to as "liquor," is generally still fairly dirty at step 208, though a certain defined level of clarity should preferably be achieved before proceeding to the next step.

Next, in step 210, a wetting agent is then added to the vessel 100. The wetting agent utilized in step 210 is preferably a wetting agent sold under the trademark Pomosperse AL36™ by Piedmont Chemical Industries. Alternatively, the wetting agent utilized may be a similar wetting agent, dispersant, solubilizer, or after-scour solution, such as a wetting agent sold under the trademark Pomoco1039™ or under the trademark Pomoco LFS OS™, both also sold by Piedmont Chemical Industries. Pomosperse AL 36™ is typically utilized for processing cotton fibers, though it may also be utilized effectively for processing hemp fibers. The first water bath may then be run preferably for approximately 10 minutes in step 212. Running the first water bath in step 212 also cleans the hemp fiber, and the liquor should again be sampled to check for clarity before proceeding further. Step 212 should bring the pH of the water bath down to below 7. The pH is preferably brought down to approximately 6.2, although the pH after step 212 is typically approximately 6.8.

Next, in step 214, a caustic compound is added to the vessel, preferably slowly over a period of about 10 minutes. The caustic compound preferably comprises caustic soda beads that have been dissolved in fresh water so that the caustic may be injected into the pressure kettle 100 as a liquid. The previously-added wetting agent allows the caustic soda to effectively penetrate the hemp fibers contained within the first water bath. After step 214, the pH of the first water bath is typically at a level of about 12.2 or higher.

Next, in step 216, the first water bath may be heated to a boiling temperature after step 214. Thus, the contents of the vessel are brought to a temperature sufficient to boil the water bath, which is typically approximately 220 degrees Fahrenheit at the pressure within the pressure kettle 100. In step 216, the batch is also preferably run for a period of about 20 minutes at approximately 220 degrees Fahrenheit. Other known wet processing methods typically heat the water bath to a maximum temperature of about 180 degrees Fahrenheit. Boiling the water bath helps the hemp fibers to further open and thus further increases the surface area of the fibers to allow effective penetration of the fibers by the caustic added in step 214. After running the first water bath in step 216, the pH of the water typically comes down to a level of approximately at least 9.3 and preferably lower than 9.3.

Next, in step 218, an acidic compound, which is preferably acetic acid, is added to the vessel 100. The batch may then be run in step 220, preferably for about 10 minutes, which typically brings the pH of the first water bath to approximately 6.5, though the pH after step 220 is preferably closer to 7. After step 220, the first water bath is drained from the vessel 100 in step 222 to leave wet hemp fibers remaining in the vessel 100. In step 224, the vessel 100 is then refilled with fresh water to form a second water bath containing the hemp fibers remaining in the vessel 100 after draining the first water bath in step 222. Step 224 is performed before the addition of lubricant and softening agents in steps 226 and 230, respectively.

In step 224, after refilling the vessel 100 with water, the second water bath may preferably be heated to a temperature of at least 100 degrees Fahrenheit, and preferably to a temperature of approximately 110 degrees Fahrenheit. After step 224, lubricant is added to the vessel 100 in step 226. The lubricant utilized in step 226 is preferably a lubricant sold under the trademark Lubricant LRD™ by Piedmont Chemical Industries, or a similar lubricating compound suitable for aiding fabric processing and improving fabric quality. The second water bath is preferably heated to approximately 110 degrees Fahrenheit in step 224 as this temperature is appropriate for the lubricant to effectively attach to and coat the hemp fibers, though the temperature may be varied depending on the type of lubricant utilized in step 226. The addition of a lubricant allows the hemp fibers to effectively untangle when drying and regain moisture. After adding the lubricant in step 226, the second water bath may then be run preferably for approximately 5 minutes in step 228. A water sample may then be taken to check the clarity and to check to see how clean the fibers are.

Next, in step 230, a softening agent is added to the vessel 100. The softening agent utilized in step 230 is preferably a softening agent sold under the trademark Pomosoft 3W™ by Piedmont Chemical Industries, or a similar softening agent suitable for softening fabric and aiding fabric processing. The second water bath may then be run preferably for approximately 15 minutes before draining the second water bath in step 232. The softening agent helps to soften the hemp fibers to aid in further processing of the fibers after the wet processing has been completed and the fibers have been dried.

After adding the softening agent and running the batch, the second water bath is dropped from the vessel in step 232 to leave wet hemp fibers remaining in the vessel 100, which generally completes the wet processing of the fibers. The wet hemp fibers may then be unloaded from the vessel 100 in step 234 for subsequent drying. The wet processed hemp fibers may then be dried in step 236. Step 238 is the end of the present method. After unloading the wet fibers in step 234, the caked hemp fibers may be broken apart into large clumps of fiber (of approximately 5-10 pounds on average) and processed through a shaker and a dryer. After drying the fibers in step 236, the fibers may optionally be run through a carding machine to disentangle and clean the fibers to produce a continuous sliver of fibers generally suitable for spinning yarn.

The present wet processing method does not include the addition of peroxide in any step during the processing of the hemp fibers. Currently known wet processing methods typically utilize peroxide in the processing of the fibers. The peroxide aids in cleaning and breaking the fibers apart and is thus a generally important step in currently known wet processing methods. However, the use of peroxide causes degradation of the fibers, which causes the fibers to become brittle and diminishes the burst strength of the fibers, which is highly undesirable in the finished product to be used in spinning yarn and producing other hemp fiber products. To aid in breaking apart the fibers during wet processing without using peroxide, the present method preferably utilizes a combination of processing steps, which include replacing the peroxide with a combination of a scouring agent and wetting agent, as well as caustic and acidic compounds, and also heating the water bath to a boil. In other known wet processing methods, the water bath is heated but is generally not heated to a boil. In accordance with the present method, boiling the water bath aids in opening the fibers to increase the surface area of the fibers. Similarly, the use of a caustic, which may also produce sodium acetate salts after the addition of acetic acid, effectively cleans the fibers, particularly when used in combination with a wetting agent that allows the caustic to effectively penetrate the fibers.

To test the effectiveness of the present wet processing method, various sample batches were treated in accordance with the present method. In one test run, 800 pounds of hemp fibers were loaded into an appropriately sized perforated basket 104 and then into a pressure kettle 100, the lid 102 of which was then sealed and closed. The pressure kettle 100 was then filled with fresh water to form a water bath with hemp fibers contained in the bath. The water bath was then heated to approximately 160 degrees Fahrenheit. Various chemical additives were then added to the water bath in sequence in accordance with the present method disclosed herein. It should be understood by one skilled in the art that the amount of each additive added to the water bath may be varied and still fall within the scope of the present disclosure. The amount of each additive may be varied according to the weight of hemp fibers being processed, as well as other properties of the hemp fibers, such as the amount of woody content, lignins, and dirt or other contaminants contained within the hemp fibers being processed. The amount of each additive may also be adjusted according the specific type of additive utilized and the concentration of each additive in liquid solution. The amount of each additive described below was found to be effective in wet processing a quantity of approximately 800 pounds of hemp fibers.

In the present test run, about one gallon of the scouring agent Pomoscour L70™ was injected into the hemp fiber contained in the water bath inside the kettle after heating the bath, and the batch was then run with fresh water for about 5 minutes. Next, about one gallon of the wetting agent Pomosperse AL 36™ was injected into the kettle 100, and the batch was then run with fresh water for about 10 minutes. Next, a liquid caustic compound comprising approximately 50 pounds of caustic soda beads dissolved in water was continuously injected into the kettle 100 gradually over a period of about 10 minutes. The water bath was then heated to about 220 degrees Fahrenheit and the batch was run with fresh water for about 20 minutes. Next, about ½ (0.5) gallons of acetic acid was injected into the kettle and the batch was run with fresh water for about 10 minutes. The water bath was then dropped, leaving behind wet hemp fibers. The kettle was then refilled with fresh water and heated to about 110 degrees Fahrenheit. Next, about one gallon of the lubricant Lubricant LRD™ was injected into the kettle and the batch was run with fresh water for about 5 minutes. Next, about one gallon of the softening agent Pomosoft 3W was injected into the kettle and the batch was run with fresh water for about 15 minutes. Finally, the water bath was dropped from the kettle, and the wet-processed hemp fibers were unloaded from the kettle. The hemp fibers were then dried. Applicant found the above method produced hemp fibers that were clean, soft, and particularly suitable for further processing and spinning.

The presently described wet processing method is effective for generally producing commercially viable quantities of hemp fibers that are soft, clean, and easily spinnable. In addition, the present wet processing method allows the hemp fibers to realign during the drying process so that the fibers are parallel when further processed by a fiber carding machine. The present method maintains fiber burst strength after processing and also eliminates lignin and pectin in the fiber, which may cause gumming of the fiber during processing, which may create unwanted fiber clumps, matting, caking, and fiber knotting. The present method also effectively removes hemp wood and trash that is generally not removed in the decortication process prior to wet processing. Although the present method has been found to be particularly advantageous in the processing of hemp fibers, it should be understood by one skilled in the art that the present method may optionally be used for wet processing of other types of fibers used commercially for making textiles, fabrics, or other products. The present method may also be particularly effective in wet processing flax fiber, for instance.

It will be appreciated that the configurations and methods shown and described herein are illustrative only, and that these specific examples are not to be considered in a limiting sense, because numerous variations are possible. The subject matter of the present disclosure includes all novel and non-obvious combinations and sub-combinations of the various systems and configurations, and other features, functions, and/or properties disclosed herein. It is understood that versions of the invention may come in different forms and embodiments. Additionally, it is understood that one of skill in the art would appreciate these various forms and embodiments as falling within the scope of the invention as disclosed herein.

What is claimed is:

1. A method of processing hemp fibers, wherein the method comprises the steps of:

loading raw hemp fibers into a vessel with water to form a first water bath containing the raw hemp fibers;

heating the first water bath;

adding a scouring agent to the first water bath;

then adding a wetting agent to the first water bath after adding the scouring agent;

then adding a caustic compound to the first water bath after adding the wetting agent;

then adding an acidic compound to the first water bath after adding the caustic compound;

then draining the first water bath from the vessel to leave wet hemp fibers remaining in the vessel;

then refilling the vessel with water to form a second water bath containing the wet hemp fibers remaining in the vessel;

then adding a lubricant to the second water bath; and then adding a softening agent to the second water bath after adding the lubricant.

2. The method of claim 1, further comprising the steps of:

draining the second water bath from the vessel after adding the softening agent to leave wet processed hemp fibers remaining in the vessel;

unloading the wet processed hemp fibers from the vessel; and drying the wet processed hemp fibers.

3. The method of claim 1, wherein the method does not include the addition of peroxide in any step.

4. The method of claim 1, wherein the step of heating the first water bath containing the hemp fibers comprises heating the first water bath to at least 150 degrees Fahrenheit.

5. The method of claim 1, further comprising the step of heating the first water bath to a boiling temperature after the step of adding the caustic compound and before the step of adding the acidic compound.

6. The method of claim 1, further comprising the step of heating the second water bath to at least 100 degrees Fahrenheit before the step of adding the lubricant.

7. The method of claim 1, wherein the caustic compound comprises caustic soda beads dissolved in water.

8. The method of claim 1, wherein the acidic compound comprises acetic acid.

9. The method of claim 1, wherein the vessel comprises a pressure kettle and a removable basket, wherein the step of loading the raw hemp fibers into the vessel with water to form the first water bath comprises loading the raw hemp fibers into the basket, placing the basket within the pressure kettle, and filling the pressure kettle with an amount of water sufficient to substantially cover the raw hemp fibers.

10. The method of claim 9, wherein the vessel further comprises a perforated pipe disposed within the pressure kettle and configured to inject liquid compounds into an interior of the pressure kettle.

11. The method of claim 1, further comprising the step of flowing fresh water into the vessel while simultaneously draining liquid of the first water bath from the vessel after the step of adding the scouring agent and before the step of adding the wetting agent.

12. The method of claim 1, further comprising the step of flowing fresh water into the vessel while simultaneously draining liquid of the first water bath from the vessel after the step of adding the wetting agent and before the step of adding the caustic compound.

13. The method of claim 1, further comprising the step of flowing fresh water into the vessel while simultaneously draining liquid of the first water bath from the vessel after the step of adding the caustic compound and before the step of adding the acidic compound.

14. The method of claim 1, further comprising the step of flowing fresh water into the vessel while simultaneously draining liquid of the first water bath from the vessel after the step of adding the acidic compound.

15. The method of claim 1, further comprising the step of flowing fresh water into the vessel while simultaneously draining liquid of the second water bath from the vessel after the step of adding the lubricant and before the step of adding the softening agent.

16. The method of claim 1, further comprising the step of flowing fresh water into the vessel while simultaneously draining liquid of the second water bath from the vessel after the step of adding the softening agent.

* * * * *